US006134335A

United States Patent [19]

Yang

[11] Patent Number: 6,134,335

[45] Date of Patent: Oct. 17, 2000

[54] DISPLAY DEVICE WITH MICROPHONE

[75] Inventor: Dong Wook Yang, Suwon, Rep. of Korea

[73] Assignee: SamSung Electronics Co., Ltd., Suwon, Rep. of Korea

[21] Appl. No.: 09/001,001

[22] Filed: Dec. 30, 1997

[30] Foreign Application Priority Data

Dec. 30, 1996 [KR] Rep. of Korea ..... 96-63615 U

[51] Int. Cl.[7] ..... H04R 25/00

[52] U.S. Cl. ..... 381/365; 381/355; 381/388; 361/683

[58] Field of Search ..... 381/306, 333, 381/355, 356, 360, 361, 365, 366, 368, 388; 361/681, 682, 683

[56] References Cited

U.S. PATENT DOCUMENTS 5,613,011 3/1997 Chase et al. ..... 381/355

*Primary Examiner*—Huyen Le
*Attorney, Agent, or Firm*—Robert E. Bushnell, Esq.

[57] ABSTRACT

A display device comprises a front case having a microphone hole, a rear case assembled with the front case into a single casing, an intermediary case positioned between the front case and the rear case, and a microphone. The intermediary case has a through hole at a position corresponding to the microphone hole. In one embodiment, the microphone is mounted adjacent to the microphone hole in the front case, and between the microphone hole and the through hole, with the front end of the microphone being directed to the microphone hole. In another embodiment, the microphone and its holder are both mounted in the front case.

18 Claims, 8 Drawing Sheets

FIG 1 *(Prior Art)*
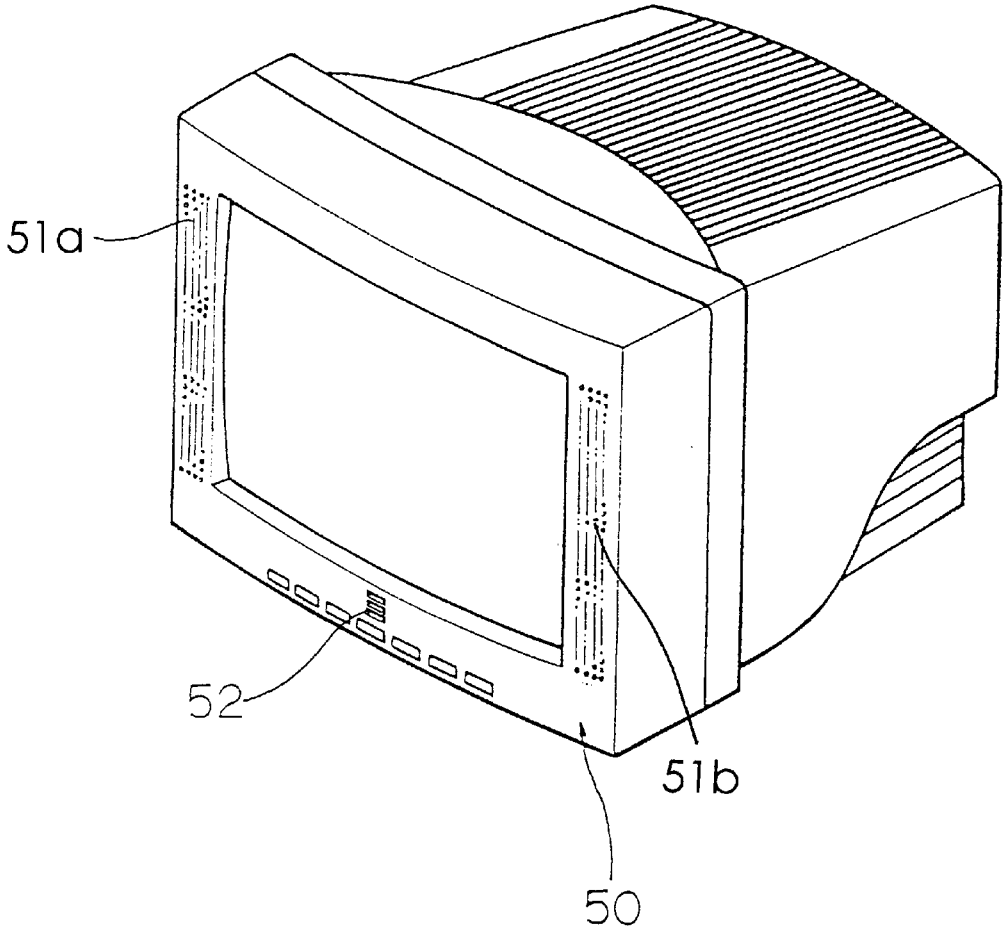

FIG 2 *(Prior Art)*
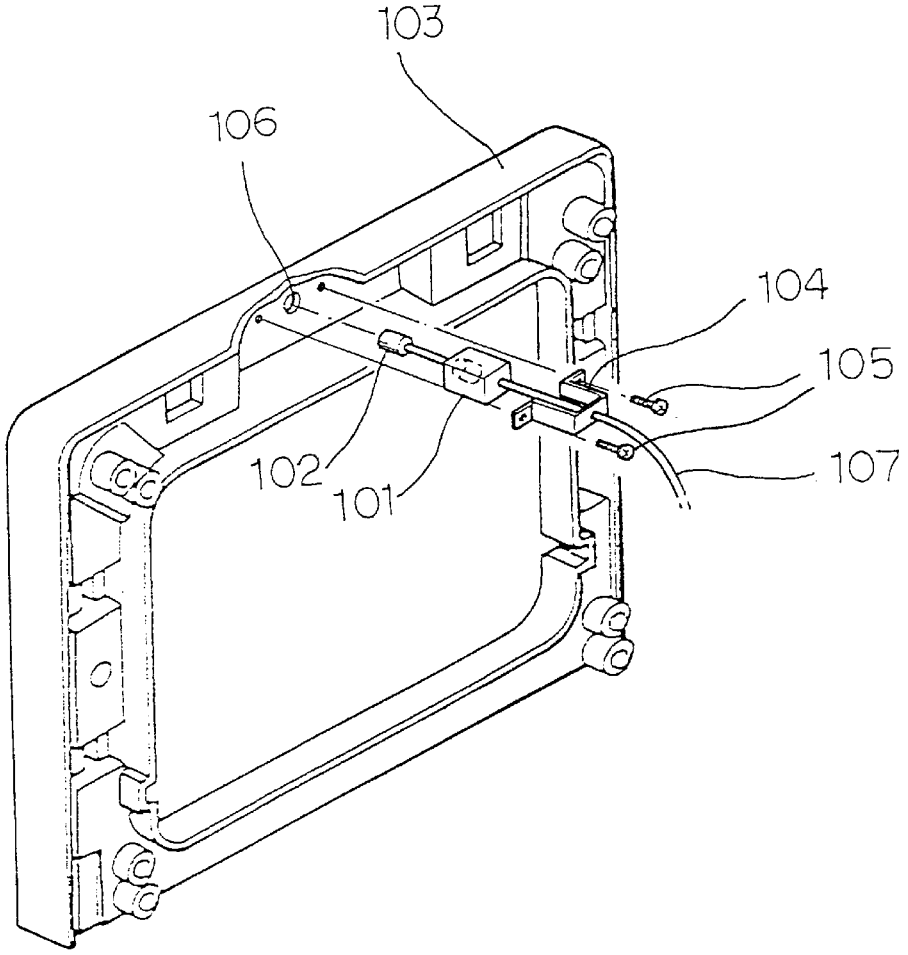

FIG 3 *(Prior Art)*
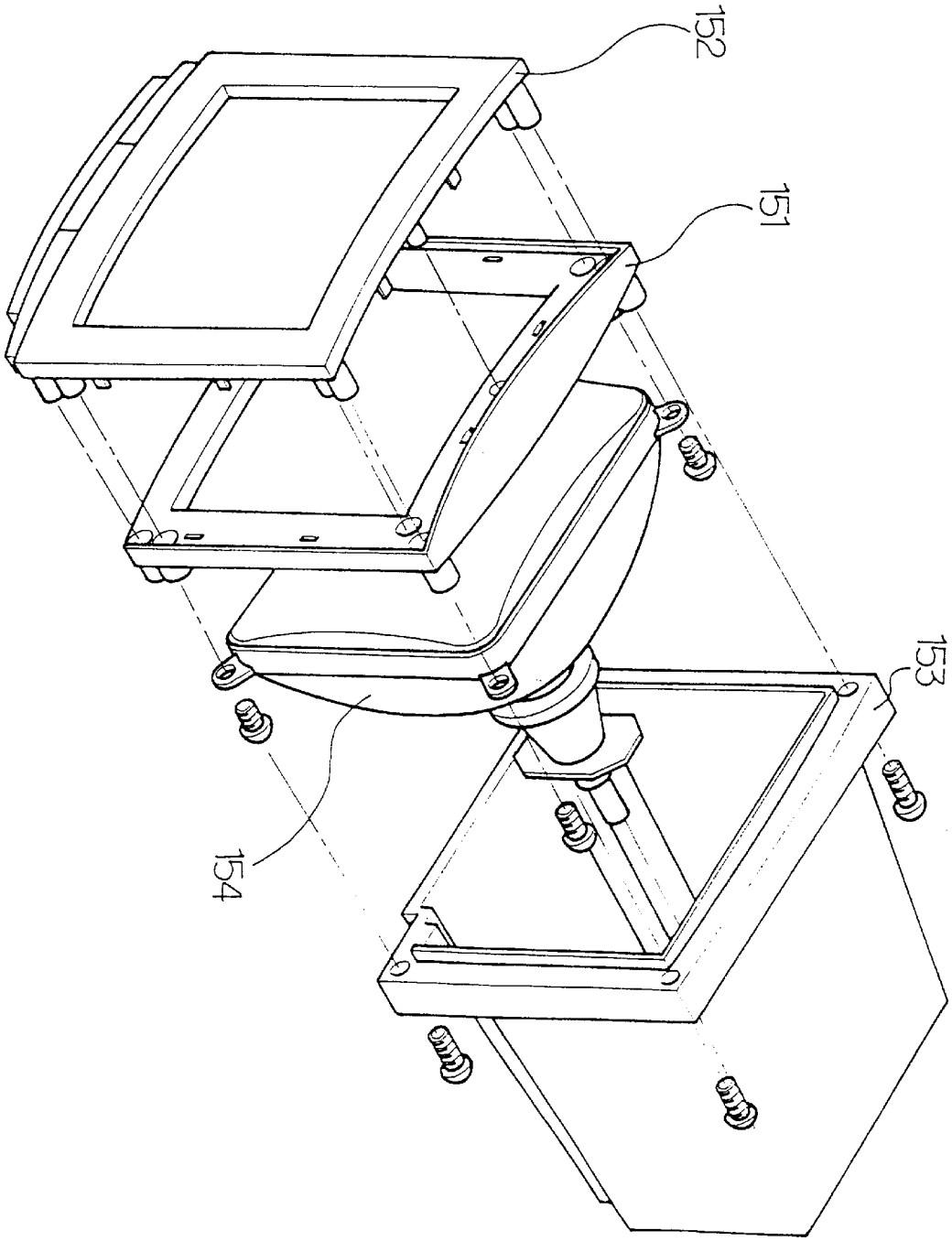

DISPLAY DEVICE WITH MICROPHONE

CLAIM OF PRIORITY

This application makes reference to, incorporates the same herein, and claims all benefits accruing under 35 U.S.C. §119 from an application for DISPLAY DEVICE WITH MICROPHONE earlier filed in the Korean Industrial Property Office on the $30^{th}$ of December 1996 and there duly assigned Serial No. 63615/1996.

BACKGROUND OF THE INVENTION

1. Technical Field

The present invention relates, in general, to a display device and, more particularly, to a display device with a microphone.

2. Related Art

As is well known to those skilled in the art, there is a great demand for PCS (personal computers), and such PCS are used for various purposes. Accordingly, such components as a sound card and a CD-ROM (compact disk read only memory) are mounted to the main body of a PC so as to provide the PC with a multimedia function.

In such a multimedia PC, a microphone and speaker(s) are added so as to provide for voice and sound input/output. Such a microphone and speaker(s) are typically installed in a monitor, thus being convenient to the user and conserving space.

A monitor with microphone and speaker(s) (for example, a 17"-type monitor. model name: Viewsonic 17GA, produced by Matsushita Co., Japan) is sold in the marketplace. As explained in more detail below, prior arrangements have relied upon the use of a plurality of screws, and this method is difficult to implement during the manufacturing process. In addition, when the microphone has to be mounted on and detached from the monitor frequently and repeatedly, the screw holes in the front case may become deformed or damaged, causing an inability to tighten the screws within the screw holes. In general, the mounting method discussed above is difficult to implement in the case where the monitor includes an intermediary case.

Therefore, there is a need to develop a display device with microphone and a method of connecting the microphone to the display device where there is no requirement to employ a plurality of screws and there is little or no chance of the screw holes becoming deformed or damaged with repeated attachment and removal of the microphone to the monitor.

The following patents are considered to be representative of the prior art, but are burdened by the disadvantages stated above: U.S. Pat. No. 5,696,814 to Tran et al., entitled Audio System For A Personal Computer, U.S. Pat. No. 5,633,943 to Daniels et al., entitled Audio System For A Personal Computer, U.S. Pat. No. 5,627,901 to Josephson et al., entitled Directional Microphone For Computer Visual Display Monitor And Method For Construction, U.S. Pat. No. 5,613,011 to Chase et al., entitled Microphone Assembly Mounted To A Bezel Which Frames A Monitor Screen Of A Computer, U.S. Pat. No. Des. 354,483 to Yamazaki, entitled Combined Flat Panel Display With A Microphone And Speakers, and U.S. Pat. No. 4,571,456 to Paulsen et al., entitled Portable Computer.

SUMMARY OF THE INVENTION

Accordingly, the present invention has been developed to solve the above problems, and an object of the present invention is to provide a display device including both a microphone and an intermediary case, with the intermediary case being mounted between a front case and a rear case.

Another object of the present invention is to provide a display device capable of allowing a microphone to be easily and detachably mounted to the display device, while effectively maintaining the fixed state of the microphone.

In order to accomplish the above object, the present invention provides a display device, comprising: a front case having a microphone hole; a rear case assembled with said front case into a single casing; an intermediary case positioned between said front case and said rear case, said intermediary case having a through hole at a position corresponding to said microphone hole; and a microphone mounted to said front case through both said microphone hole and said through hole with the front end of said microphone being directed to said microphone hole.

The display device further comprises a microphone holder having a body, said body at least partially receiving said microphone and being provided with a snap arm for elastically supporting the microphone holder in said through hole of the intermediary case.

The display device further comprises a box-shaped holder mount formed around said through hole of said intermediary case; and a plurality of guides formed on the inside wall of said holder mount, thus guiding and fixing said microphone holder in said through hole.

The present invention further provides a display device, comprising: a front case having a microphone hole; a rear case assembled with said front case into a single casing; a holder mount formed around said microphone hole of said front case; and a microphone holder having a body, said body at least partially receiving said microphone and being provided with a snap arm for elastically supporting the microphone holder in said holder mount.

The microphone holder includes a wedged portion at the free end of said snap arm, and said mount includes a locking groove, said wedged portion being locked into said locking groove.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 1 is a perspective schematic view of a monitor with both a microphone and speakers;

FIG. 2 is an exploded perspective view illustrating the structure for mounting a microphone to the rear surface of a front case;

FIG. 3 is an exploded perspective view of a typical monitor having an intermediary case positioned between a front case and a rear case;

DESCRIPTION OF THE PREFERRED EMBODIMENT

Figure 4A:
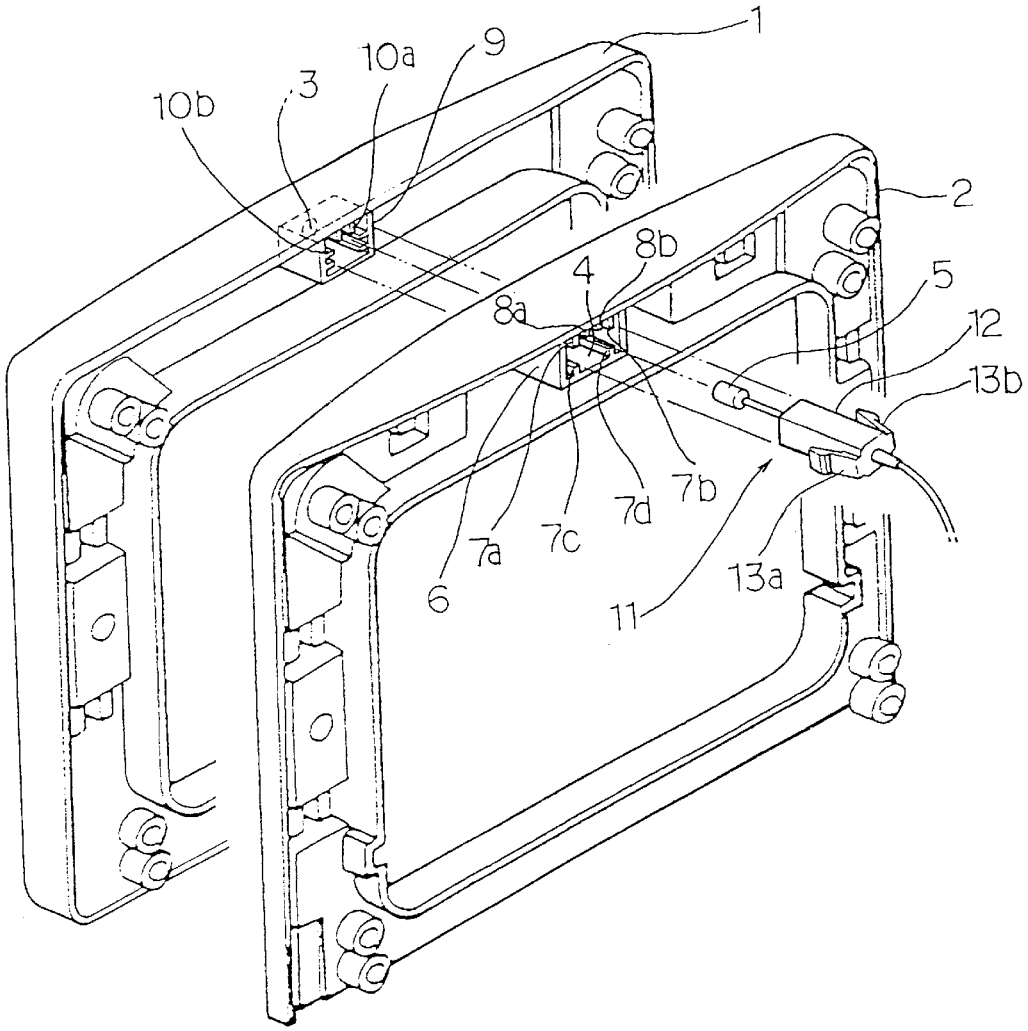
FIG. 4A is an exploded perspective view of a display device according to a first embodiment of the present invention.

FIG. 1 shows the construction of the 17"-type monitor produced by Matsushita Co. and discussed above. As shown in FIG. 1, left and right speakers are integrally mounted to both front sides of the monitor, with a microphone being mounted to the lower central portion of the monitor. Speaker holes 51*a* and 51*b* and a microphone hole 52 are formed on front case 50 at positions where the speakers and the microphone are mounted to the monitor.

As shown in FIG. 2, the microphone 102 is mounted in the monitor with a protection member 101. That is, the microphone 102 is safely received in the protection member 101, which is made of an elastic material, such as rubber. The member 101, with the microphone 102, is then fixed to a predetermined rear portion of a front case 103 with both an additional locking member 104 and screws 105. In this case, the front end of the microphone 102 is exposed to the front of the monitor through a microphone hole 106 of the front case 103. The microphone 102 is connected to the voice input terminal or port (not shown) of the sound card by a connection line 107.

However, the above-mentioned monitor is problematic in that it is very difficult to mount the microphone onto the monitor during manufacture or to replace the microphone with a new one. That is, the microphone has to be mounted to the monitor by releasing and tightening a plurality of screws 105 one by one. In addition, when the microphone is frequently and repeatedly attached to and removed from the front case, which is mainly made of a synthetic resin, the screw holes of the front case may become deformed or damaged, thus causing the screws to be loose when mounted. As a result, the protection member 101 and microphone 102 may not maintain their correct positions, thus reducing voice receiving sensitivity of the microphone 102 and occasionally allowing the microphone 102 to be unexpectedly removed from the front case.

In order to overcome the above problems, a mounting method in which the protection member 101 is adherently fixed to the rear surface of the front case 103 has been proposed. However, such a mounting method has a problem in that it is very difficult to remove the bonding agent remaining on the front case 103 when the microphone 102 is detached from the front case 103. Therefore, such a method is not widely used.

Also, the above-mentioned mounting method is difficult to apply to a monitor which includes an intermediary case mounted between front and rear cases. A monitor with such an intermediary case (for example, 17"-type monitor, model names: Syncmaster 17GLSi and Syncmaster 17GLi produced by Samsung Electronic Co., Korea) is sold in the market place, and is schematically shown in FIG. 3. As shown in FIG. 3, such a monitor comprises a front case 152 and a rear case 153 with an intermediary case 151 being mounted at a position between the front case 152 and the rear case 153. The intermediary case 151 supports the weight of a cathode ray tube 154 in cooperation with the front and rear cases 152 and 153, thereby preventing any sagging of the monitor case. Also, such an intermediary case 151 is called a "Color Band" because the case 151 is painted with a color, distinguishable from the colors of the front case 152 and the rear case 153 in an effort to improve the design of the monitor.

When a microphone is mounted in such a monitor, the microphone mounting portion of the monitor is positioned between the front case 152 and the intermediary case 151. Thus, it is difficult to provide a space for the microphone, and the use of screws to mount the microphone is hindered by the intermediary case 151. Therefore, the mounting and detaching of the microphone relative to the monitor is very difficult.

FIG. 4A is an exploded perspective view of a display device in accordance with a first embodiment of the present invention.

In this first embodiment, the display device is used with a monitor comprising of a front case 1 and a rear case (not shown, see FIG. 3) with an intermediary case 2 being mounted between the front case 1 and the rear case.

A microphone hole 3 is formed on the upper portion of the front case 1 by a perforating process, while a hole 4 is formed on the upper portion of the intermediary case 2 at a position corresponding to the microphone hole 3. A microphone 5 is fitted into the microphone hole 3 after passing through the hole 4. In such a case, the front end of the microphone 5 is directed to the microphone hole 3.

In the present invention, the microphone 5 may be directly mounted on the front case 1 as described above. However, it is more preferable to mount the microphone 5 on the front case 1 using a microphone holder 11. The microphone holder 11 fits into the microphone hole 3 through the hole 4 of the intermediary case 2.

Figure 4B:
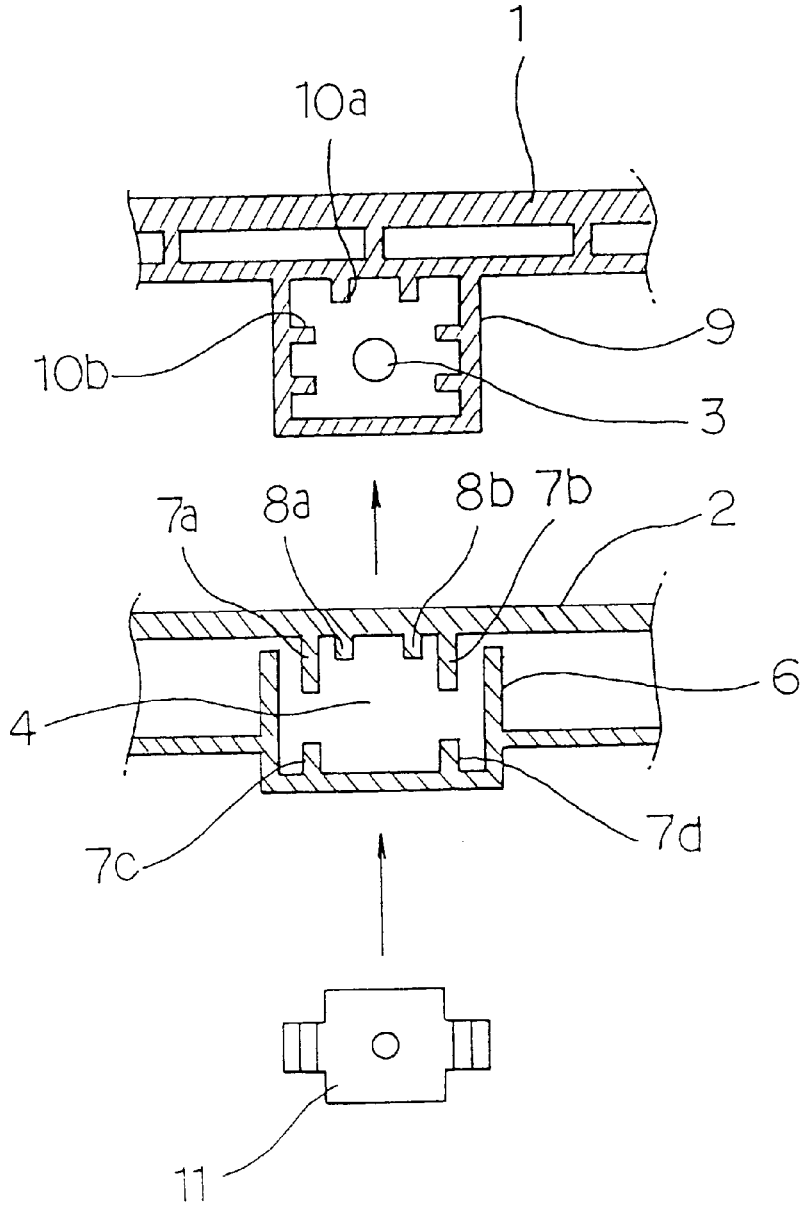
FIG. 4B is a cross-sectional view showing a microphone holder of FIG. 4A.
Figure 5:
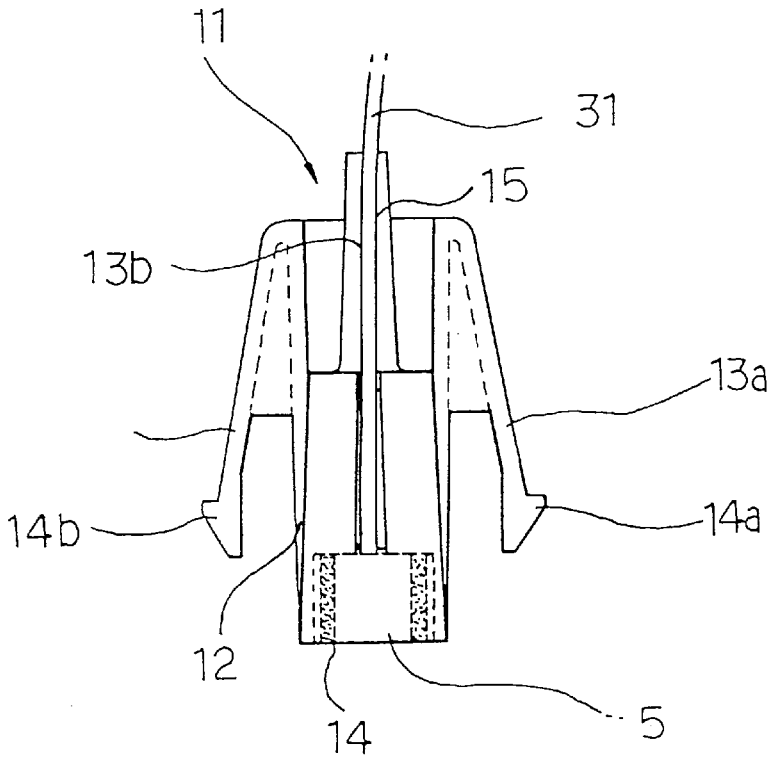
FIG. 5 is a cross-sectional schematic view illustrating the mounting method according to the first embodiment of this invention.
Figure 6:
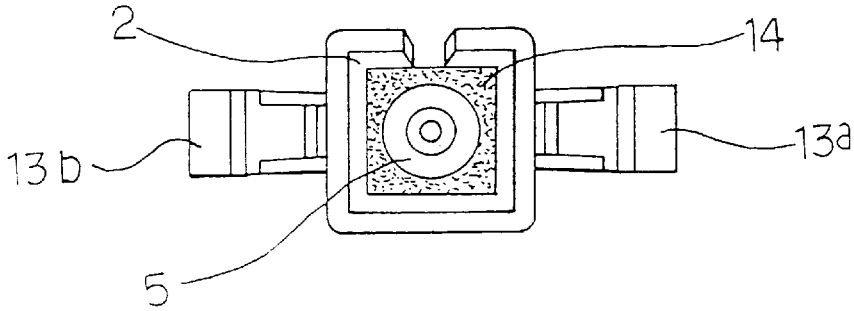
FIG. 6 is a front view showing the microphone holder of FIG. 5.

As shown in FIGS. 4B, 5 and 6, the microphone holder 11 comprises a body 12 and two snap arms 13*a* and 13*b*. The microphone 5 is embedded into the body 12, with the front end of the microphone 5 being exposed to the outside of the body 12 and being directed to a voice or sound source. The body 12 is elastically fitted into the hole 4 by the two snap arms 13*a* and 13*b*.

In the present invention, the microphone 5 may be directly embedded into the microphone holder 11. However, it is more preferable to mount the microphone 5 to the holder 11 using an elastic protection member 14. In the event of using such an elastic protection member 14, the microphone 5 is inserted into the protection member 14 prior to pressing the protection member 14 into the body 12. In such a case, the front end of the microphone 5 has to be projected from the front surface of the front case 1.

The two snap arms 13*a* and 13*b* are integrated with both side surfaces of the body 12. The snap arms 13*a* and 13*b* extend in an inclined manner in opposite directions, thus individually having an angle of inclination and diverging from an associated side surface of the body 12. Two wedged portions 14*a* and 14*b* are formed on the free ends of the two snap arms 13*a* and 13*b*, respectively.

A hole 15 is formed on the front central portion of body 12, and a connection line 31 passes through the hole 15 and connects the microphone 5 to the voice input terminal or port of a sound card of a PC body.

The method of mounting the holder 11 to a monitor is described below with reference to FIGS. 4A and 4B.

A holder mount 6, having a box shape, is formed around the hole 4 of the intermediary case 2. A plurality of guides 7*a*, 7*b*, 7*c* and 7*d* are formed on the interior of the holder mount 6 in such a manner that the guides 7*a*, 7*b*, 7*c* and 7*d* protrude from the inner surface of the mount 6. The guides 7*a*, 7*b*, 7*c* and 7*d* comprise a pair of upper guides 7*a* and 7*b*, which are formed on the upper wall of the mount 6 and are spaced apart from each other, and a pair of lower guides 7*a* and 7*b*, which are formed on the lower wall of the mount 6 and are spaced apart from each other. Thus, an aperture having predetermined distance dimensions is formed between each of the two upper guides 7*a* and 7*b* and associated lower guides 7*c* and 7*d*.

When the holder 11 is inserted into the hole 4, the guides 7*a*, 7*b*, 7*c* and 7*d* guide and fix the holder 11. That is, the two snap arms 13*a* and 13*b* of the holder 11 are guided into the apertures between the upper guides 7*a* and 7*b* and the lower guides 7*c* and 7*d*. Thus, the width of each aperture corresponds to the width of each of the snap arms 1 3*a* and 1 3*b*, preferably. Also, the inner surface of the intermediary case 2 is provided with a pair of ribs 8*a* and 8*b* at a position between the upper guides 7*a* and 7*b*. When the holder 11 is fitted into the hole 4, the ribs 8*a* and 8*b* are brought into contact with the top surface of the body 12 of the holder 11. Thus, the holder 11 is almost completely prevented from being moved.

On the other hand, a microphone mount 9, having a box shape, is formed around the circumference of the microphone hole 3 of the front case 1. A plurality of guides 10*a* and 10*b* are formed on the interior of the microphone mount 9 in such a manner that the guides 10*a* and 10*b* protrude from the inner surface of the mount 9. As described above, when the holder 11 is fitted into the microphone hole 3 after passing through the hole 4, such guides 10*a* and 10*b* guide and fix the holder 11, thereby preventing the holder 11 from being moved.

Figure 7:
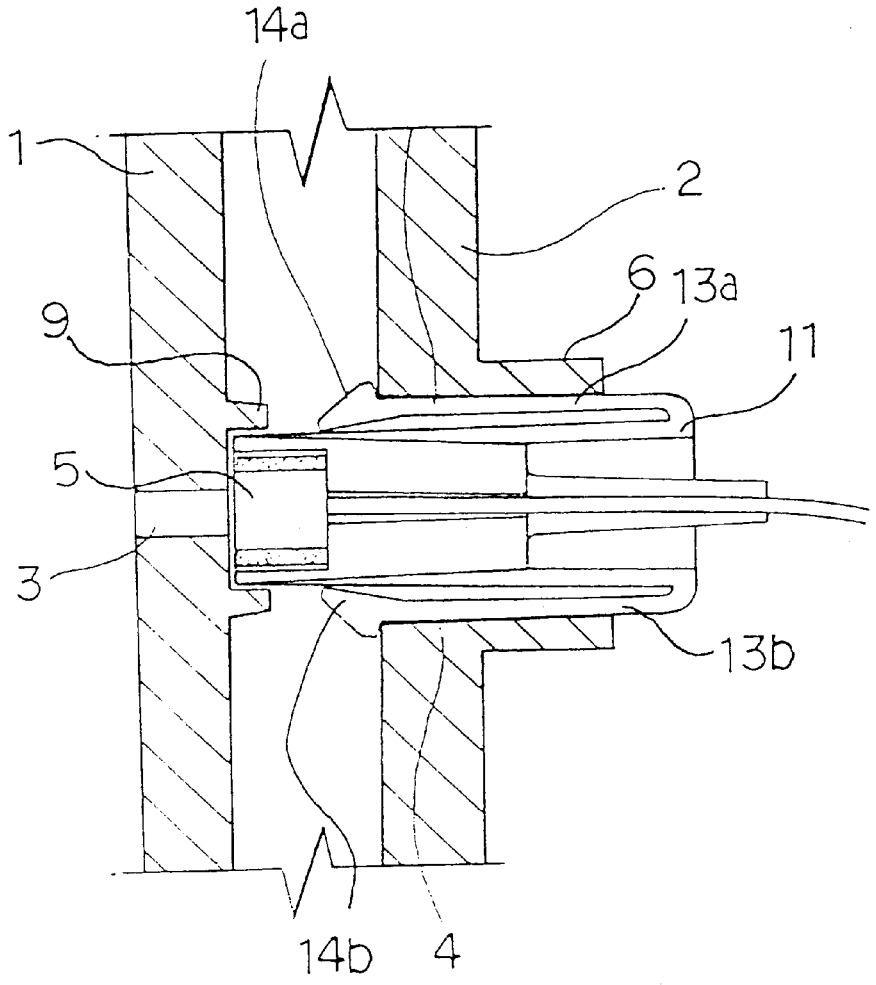
FIG. 7 is a cross-sectional schematic view showing the mounted state of the microphone holder according to the first embodiment of this invention.

FIG. 7 is a cross-sectional schematic view showing the mounted state of the microphone holder 11 according to this invention.

When the microphone holder 11 is fitted into the hole 4 of the intermediary case 2, the inclination angle of the snap arms 1 3*a* and 1 3*b* is reduced because the snap arms 1 3*a* and 1 3*b* are brought into contact with the inside wall of the mount 6. Thereafter, the wedged portions 14*a* and 14*b* formed on free ends of the snap arms 13*a* and 13*b* pass through the hole 4 and are locked into the jaw portion of the hole 4. Thus, even when the microphone holder 11 is subjected to any external force, the holder 11 is not removed from the hole 4. In such a case, the front end of the microphone 5 is brought into slight contact with the front surface of the microphone hole 3. As a result, when the microphone holder 11 is completely seated in its desired position, the front end of microphone 5 is exposed to the microphone hole 3. Therefore, the microphone 5 effectively receives voice or sound. Also, the microphone 5 is strongly fixed to the monitor for a long time because the holder 11 is held by both the mount 9 of the front case 1 and the mount 6 of the intermediary case 2.

In order to separate the holder 11 from the case 2 when necessary, the snap arms 13*a* and 13*b*, exposed to the exterior of the holder mount 6, are manually pressed. Then, the wedged portions 14*a* and 14*b* are released from their locked position, thereby allowing the holder 11 to be easily removed.

The length and width of the holder 11, the distance between the front and intermediary cases, and the diameter of the hole 4, etc. may be variously changed in accordance with design requirements without affecting the functioning of this invention.

Figure 8:
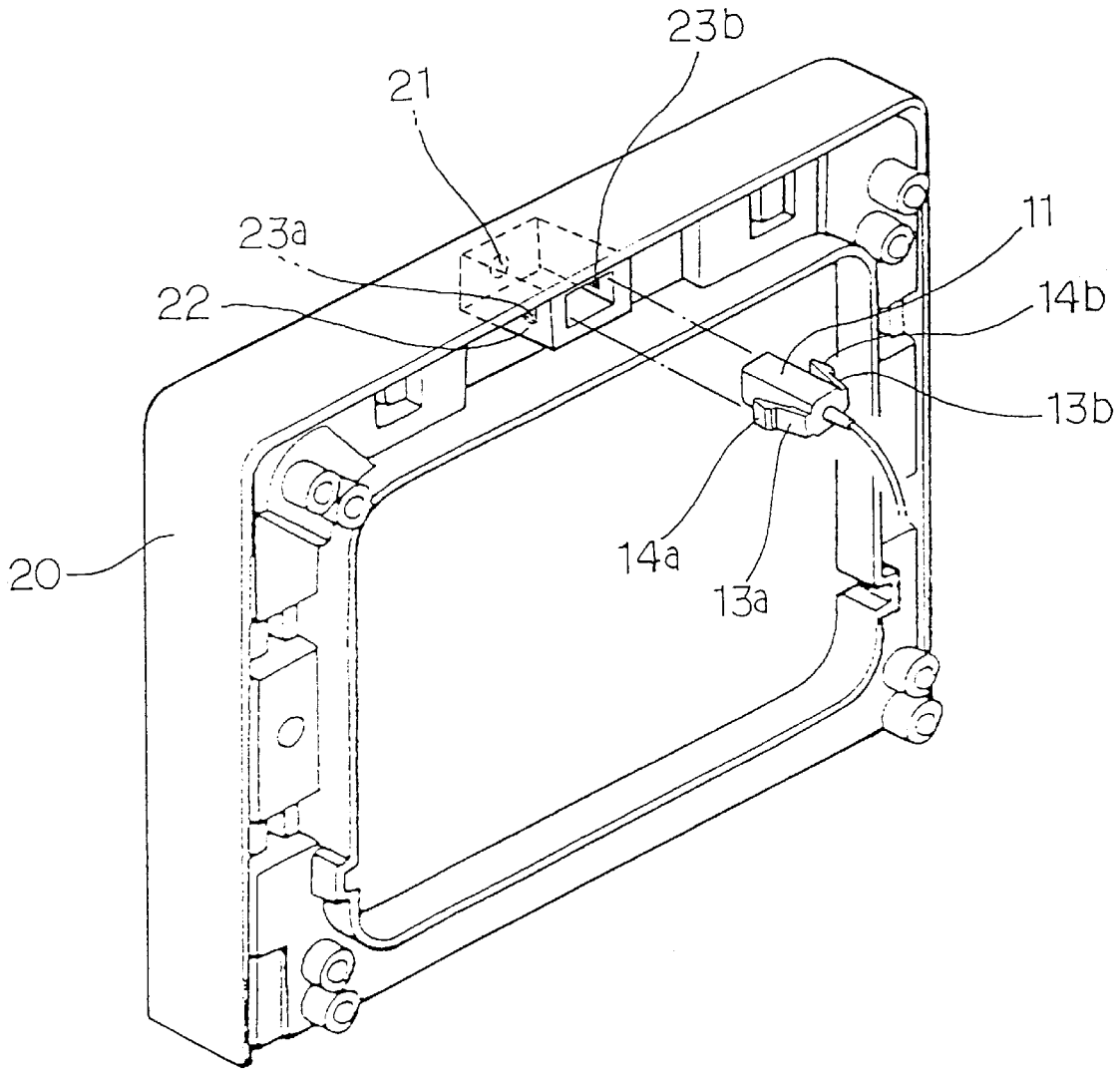
FIG. 8 is an exploded perspective view of an display device according to a second embodiment of the present invention.

FIG. 8 is a view illustrating a display device in accordance with a second embodiment of the this invention. In the second embodiment, the display device is used with a monitor free from an intermediary case. The shape and structure of a microphone holder in this embodiment are identical to those of the microphone holder according to the first embodiment of the this invention. As shown in FIG. 8, a holder mount 22 is formed around the circumference of a microphone hole 21 of a front case 20, and a microphone holder 11 is fitted into the mount 22. Two locking grooves 23*a* and 23*b* are formed on the inner wall of the holder mount 22. Two wedged portions 14*a* and 14*b* are locked into the locking grooves 23*a* and 23*b*, respectively.

In order to mount the holder 11 to the front case 20, the holder 11 is fitted into the mount 22. That is, the inclination angle of the snap arms 13*a* and 13*b* is reduced because the snap arms 13*a* and 13*b* are brought into contact with the inside wall of the mount 22. Thereafter, the wedged portions 14*a* and 14*b* formed on the free ends of the snap arms 13*a* and 13*b* are locked into the locking grooves 23*a* and 23*b*. Thus, even when the microphone holder 11 is subjected to any external force, the holder 11 is not removed from the mount 22. In such a case, the front end of the microphone 5 is brought into slight contact with the front surface of the microphone hole 21. As a result, when the microphone holder 11 is completely placed in its desired position, the front end of microphone 5 is exposed to the microphone hole 21. Therefore, the microphone 5 effectively receives voice or sound.

In order to separate the holder 11 from the case 20, in the same manner as in the first embodiment of the this invention, the snap arms 13*a* and 13*b*, exposed to the exterior of the holder mount 22, are manually pressed. Then, the wedged portions 14*a* and 14*b* are released from their locked position, thereby allowing the holder 11 to be easily removed.

As mentioned above, the display device of this invention allows a holder with a microphone to be easily and detachably set in the monitor including an intermediary case mounted between the front and rear cases. Furthermore, the holder, with two snap arms, is elastically fitted into the holder mount formed around the microphone hole of the front case or into the holder mount formed around the hole of the intermediary case. Therefore, the microphone is easily and detachably set in a display device, and is effectively maintained at its fixed position for a long time.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A display device having a cathode ray tube, said display device comprising:

a front case having a microphone hole formed therein;

a rear case assembled with said front case to form a single casing;

an intermediary case positioned between said front case and said rear case, and cooperating with said front case and said rear case to support said cathode ray tube, said intermediary case having a through hole formed therein at a position corresponding to said microphone hole;

a microphone mounted adjacent to said microphone hole in said front case, and between said microphone hole in said front case and said through hole in said intermediary case; and a microphone holder having a body disposed in said through hole of said intermediary case, said body at least partially receiving said microphone and being provided with a snap arm for elastically supporting the microphone holder when said body is disposed in said through hole of said intermediary case.

2. The display device as claimed in claim 1, further comprising:

a box-shaped holder mount formed around said through hole of said intermediary case; and a plurality of guides formed on an inside wall of said holder mount for guiding and fixing said microphone holder in said through hole.

3. The display device as claimed in claim 2, further comprising:

a box-shaped microphone mount formed around said microphone hole for at least partially receiving the body of the microphone holder; and a plurality of guides formed on the inside wall of said holder mount for guiding and fixing said microphone holder, thereby preventing said body from being moved.

4. The display device as claimed in claim 3, wherein said snap arm has a wedged portion formed on a free end thereof, said wedged portion being locked into a jaw portion of said through hole of said intermediary case when said microphone holder is disposed in said through hole of said intermediary case.

5. The display device as claimed in claim 2, wherein said snap arm has a wedged portion formed on a free end thereof, said wedged portion being locked into a jaw portion of said through hole of said intermediary case when said microphone holder is disposed in said through hole of said intermediary case.

6. The display device as claimed in claim 1, further comprising:

a box-shaped microphone mount formed around said microphone hole for at least partially receiving the body of the microphone holder; and a plurality of guides formed on the inside wall of said holder mount for guiding and fixing said microphone holder, thereby preventing said body from being moved.

7. The display device as claimed in claim 6, wherein said snap arm has a wedged portion formed on a free end thereof, said wedged portion being locked into a jaw portion of said through hole of said intermediary case when said microphone holder is disposed in said through hole of said intermediary case.

8. A display device, comprising:

a front case having a microphone hole formed therein;

a rear case assembled with said front case to form a single casing;

an intermediary case positioned between said front case and said rear case. said intermediary case having a through hole formed therein at a position corresponding to said microphone hole; and a microphone mounted adjacent to said microphone hole in said front case, and between said microphone hole in said front case and said through hole in said intermediary case;

said display device further comprising:

a microphone holder for holding the microphone;

a box-shaped holder mount formed around said through hole of said intermediary case; and a plurality of guides formed on an inside wall of said holder mount for guiding and fixing said microphone holder in said through hole.

9. A display device, comprising:

a front case having a microphone hole formed therein;

a rear case;

an intermediary case disposed between said front case and said rear case, and assembled with said front case and said rear case to form a single casing, said intermediary case having a through hole formed therein at a position aligned with said microphone hole in said front case;

a holder mount formed around said microphone hole of said front case; and a microphone holder for holding a microphone and having a body disposed in said holder mount, said body at least partially receiving said microphone and being provided with a snap arm for elastically supporting the microphone holder in said holder mount.

10. The display device as claimed in claim 9, wherein said snap arm has a wedged portion formed on a free end thereof, and said holder mount includes a locking groove, said wedged portion being locked into said locking groove when said microphone holder is disposed in said holder mount.

11. A display device having a cathode ray tube, said display device comprising:

a front case having a microphone hole formed therein;

a rear case;

an intermediary case positioned between said front case and said rear case, and cooperating with said front case and said rear case to support said cathode ray tube, said intermediary case having a through hole formed therein at a position corresponding to said microphone hole;

a microphone; and means for mounting said microphone adjacent to said microphone hole in said front case, and between said microphone hole in said front case and said through hole in said intermediary case;

wherein said mounting means comprises a microphone holder having a body disposed in said through hole of said intermediary case, and at least one snap arm connected to said body for elastically supporting said microphone holder when said body is disposed in said through hole of said intermediary case.

12. The display device as claimed in claim 11, further comprising:

a box-shaped holder mount formed around said through hole of said intermediary case; and a plurality of guides formed on an inside wall of said holder mount for guiding and fixing said microphone holder in said through hole.

13. The display device as claimed in claim 12, further comprising:

a box-shaped microphone mount formed around said microphone hole for at least partially receiving the body of the microphone holder; and a plurality of guides formed on the inside wall of said holder mount for guiding and fixing said microphone holder, thereby preventing said body from being moved.

14. The display device as claimed in claim 13, wherein said snap arm has a wedged portion formed on a free end thereof, said wedged portion being locked into a jaw portion of said through hole of said intermediary case when said microphone holder is disposed in said through hole of said intermediary case.

15. The display device as claimed in claim 12, wherein said snap arm has a wedged portion formed on a free end thereof, said wedged portion being locked into a jaw portion of said through hole of said intermediary case when said microphone holder is disposed in said through hole of said intermediary case.

16. The display device as claimed in claim 11, further comprising:

a box-shaped microphone mount formed around said microphone hole for at least partially receiving the body of the microphone holder; and a plurality of guides formed on the inside wall of said holder mount for guiding and fixing said microphone holder, thereby preventing said body from being moved.

17. The display device as claimed in claim 16, wherein said snap arm has a wedged portion formed on a free end thereof, said wedged portion being locked into a jaw portion of said through hole of said intermediary case when said microphone holder is disposed in said through hole of said intermediary case.

18. A display device, comprising:

a front case having a microphone hole formed therein;

a rear case;

an intermediary case positioned between said front case and said rear case, said intermediary case having a through hole formed therein at a position corresponding to said microphone hole;

a microphone; and means for mounting said microphone adjacent to said microphone hole in said front case, and between said microphone hole in said front case and said through hole in said intermediary case;

said display device further comprising:

a box-shaped holder mount formed around said through hole of said intermediary case; and a plurality of guides formed on an inside wall of said holder mount for guiding and fixing said mounting means in said through hole.

* * * * *